US011359406B2

(12) United States Patent
Su

(10) Patent No.: US 11,359,406 B2
(45) Date of Patent: Jun. 14, 2022

(54) NUMBER LOCK

(71) Applicant: INGAMAR CO., LTD., Lugang Township, Changhua County (TW)

(72) Inventor: Jason Su, Lugang Township, Changhua County (TW)

(73) Assignee: INGAMAR CO., LTD., Changhua County (TW)

( * ) Notice: Subject to any disclaimer, the term of this patent is extended or adjusted under 35 U.S.C. 154(b) by 189 days.

(21) Appl. No.: 16/795,550

(22) Filed: Feb. 19, 2020

(65) Prior Publication Data

US 2021/0254369 A1 Aug. 19, 2021

(51) Int. Cl.
*E05B 37/02* (2006.01)

(52) U.S. Cl.
CPC ..... *E05B 37/02* (2013.01)

(58) Field of Classification Search
CPC ..... E05B 37/02; E05B 37/00; E05B 73/0082; E05B 37/025; E05B 73/005
USPC ..... 70/291, 14, 57, 58, 301, 306, 308, 309, 70/311, 312
See application file for complete search history.

(56) References Cited

U.S. PATENT DOCUMENTS 6,058,744 A * 5/2000 Ling ..... E05B 37/025 70/28
6,449,992 B1 * 9/2002 Yu ..... E05B 73/0082 70/23
6,523,373 B1 * 2/2003 Su ..... E05B 73/0005 70/28
6,619,081 B1 * 9/2003 Yu ..... E05B 73/0005 70/14
7,185,518 B1 * 3/2007 Huang ..... E05B 73/0082 70/14
8,739,583 B2 * 6/2014 Avganim ..... E05B 37/02 70/58
9,574,378 B2 * 2/2017 Wu ..... E05B 37/02
10,378,239 B2 * 8/2019 Avganim ..... E05B 47/00
10,378,249 B1 * 8/2019 Lee ..... E05B 73/0082
2003/0200775 A1 * 10/2003 Yu ..... E05B 37/025 70/58
2007/0157681 A1 * 7/2007 Miao ..... E05B 37/025 70/58
2014/0069153 A1 * 3/2014 Wu ..... E05B 73/0082 70/58
2020/0080346 A1 * 3/2020 Wu ..... E05B 73/0082
2020/0181950 A1 * 6/2020 Su ..... E05B 37/02

* cited by examiner

*Primary Examiner* — Suzanne L Barrett

(57) ABSTRACT

A number lock has a main rod, a casing, a push knob and two buckles. The main rod is jacketed with a plurality of number rollers, and each number roller is capable of controlling movement of the main rod. One end of the main rod has an operating block and an ejector. The casing has two corresponding pieces enclosing the main rod and exposes a portion of each number roller. The casing further has a displacement space for accepting the operating block and a semispherical space for accepting the ejector. The casing has an elastic piece pushing against each number roller for positioning. One end of the casing is provided with a round rod, and the round rod has a ball socket connected to a cable. The push knob is partially disposed in the displacement space of the casing and connected to the operating block.

7 Claims, 7 Drawing Sheets

A-A

NUMBER LOCK

BACKGROUND of INVENTION

Field of Invention

The present invention relates to a lock, and more particularly to a number lock.

Description of the Related Art

Currently, electronic devices are often provided in public places for use, such as desktop computers or notebook computers in computer classrooms, libraries, public institutions or stores. However, the notebook computer is small size so it is very subjective to being stolen. Therefore, locks are used on the electronic devices for security in public places. For different electronic devices, the keyhole designs of electronic devices are different. Commonly, the keyholes have openings smaller than the inside slot, and the engaging arm of the lock engages the inside of the keyhole. However, there are still some shortcomings as follows: when the engaging arm engages with the keyhole of the electronic devices, the number roller of the lock may face downward or rearward, making it difficult for users to see the current number to operate.

Therefore, it is desirable to provide a number lock to mitigate and/or obviate the aforementioned problems

SUMMARY OF THE INVENTION

An objective of present invention is to a number lock, which is capable of improving the above-mention problems.

In order to achieve the above mentioned objective, a number lock has a main rod, a casing, a push knob and two buckles. The main rod is jacketed with a plurality of number rollers, and each number roller is capable of controlling movement of the main rod. One end of the main rod has an operating block and an ejector. The casing has two corresponding pieces enclosing the main rod and exposes a portion of each number roller. The casing further has a displacement space for accepting the operating block and a semispherical space for accepting the ejector. The casing has an elastic piece pushing against each number roller for positioning. One end of the casing is provided with a round rod, and the round rod has a ball socket connected to a cable. The push knob is partially disposed in the displacement space of the casing and connected to the operating block. The operating block is provided with a through aperture, and the push knob utilizes a cylinder that is inserted in the through aperture to control the movement the main rod. The two buckles respectively and symmetrically have an arc section at one end disposed in the semispherical space of the casing and allowing the ejector to pass through the arc section. The ejector is a round bar with a tapered head, and each buckle respectively has a receiving slot for accepting the ejector before ejection while are closed to each other.

Other objects, advantages, and novel features of invention will become more apparent from the following detailed description when taken in conjunction with the accompanying drawings.

DETAILED DESCRIPTION OF THE PREFERRED EMBODIMENT

Figure 1:
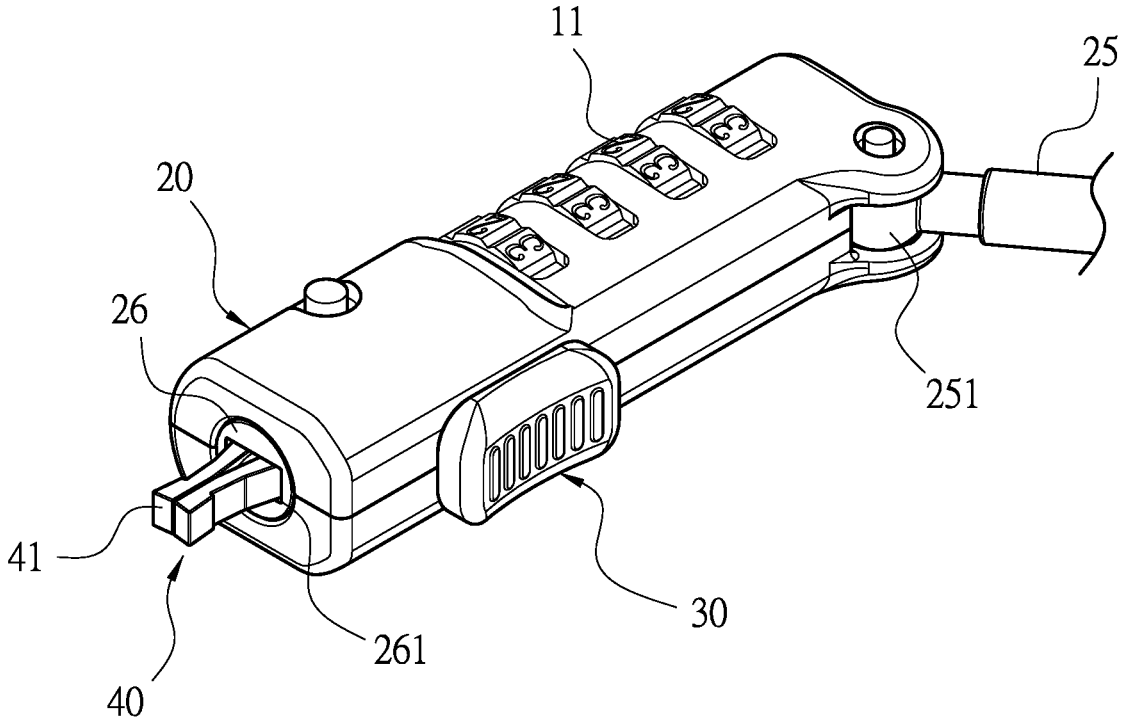
FIG. 1 is a perspective view of a preferred embodiment according to the preset invention.
Figure 2:
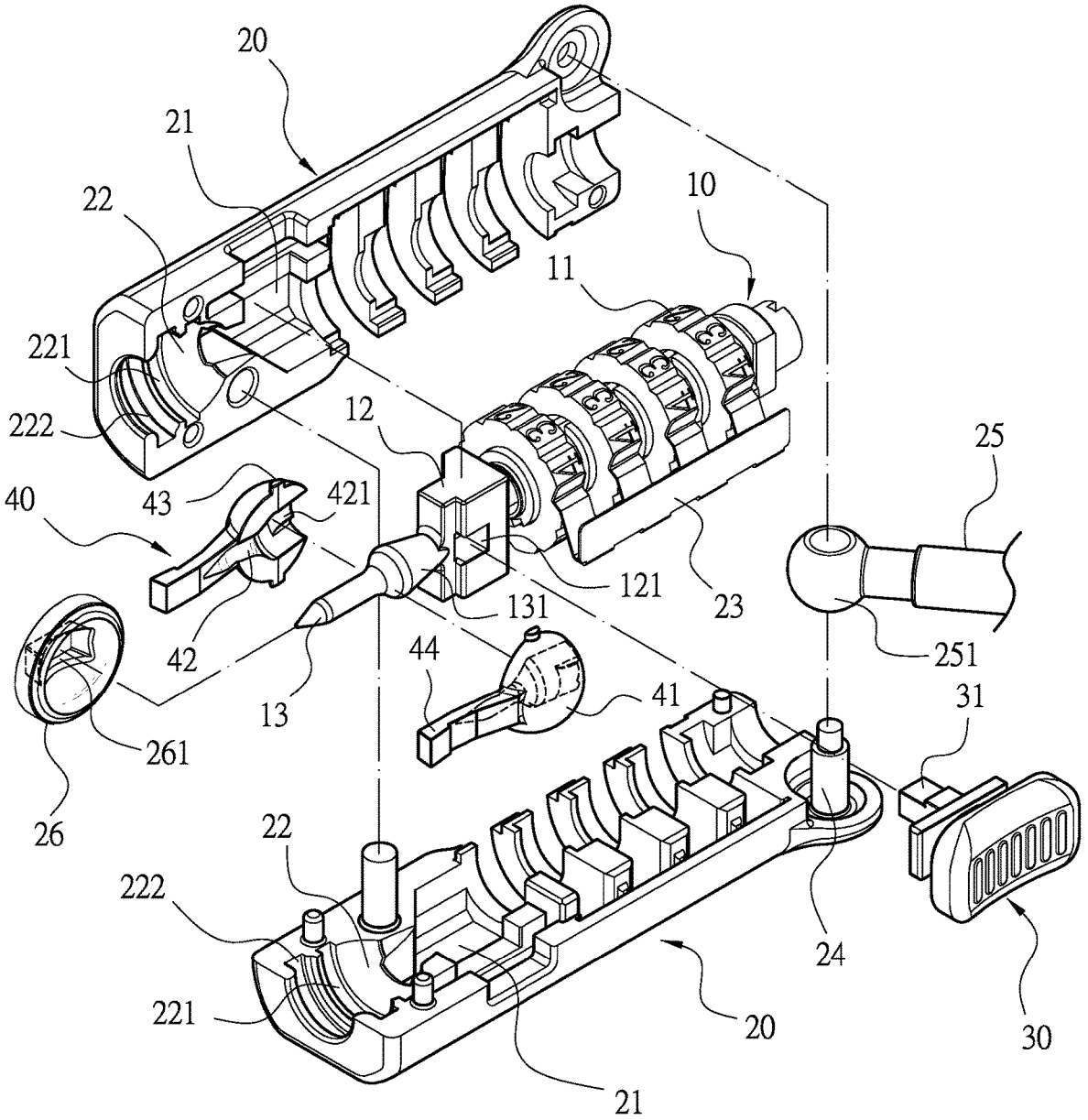
FIG. 2 is a three-dimensional exploded view of the preferred embodiment according to the preset invention.
Figure 3:
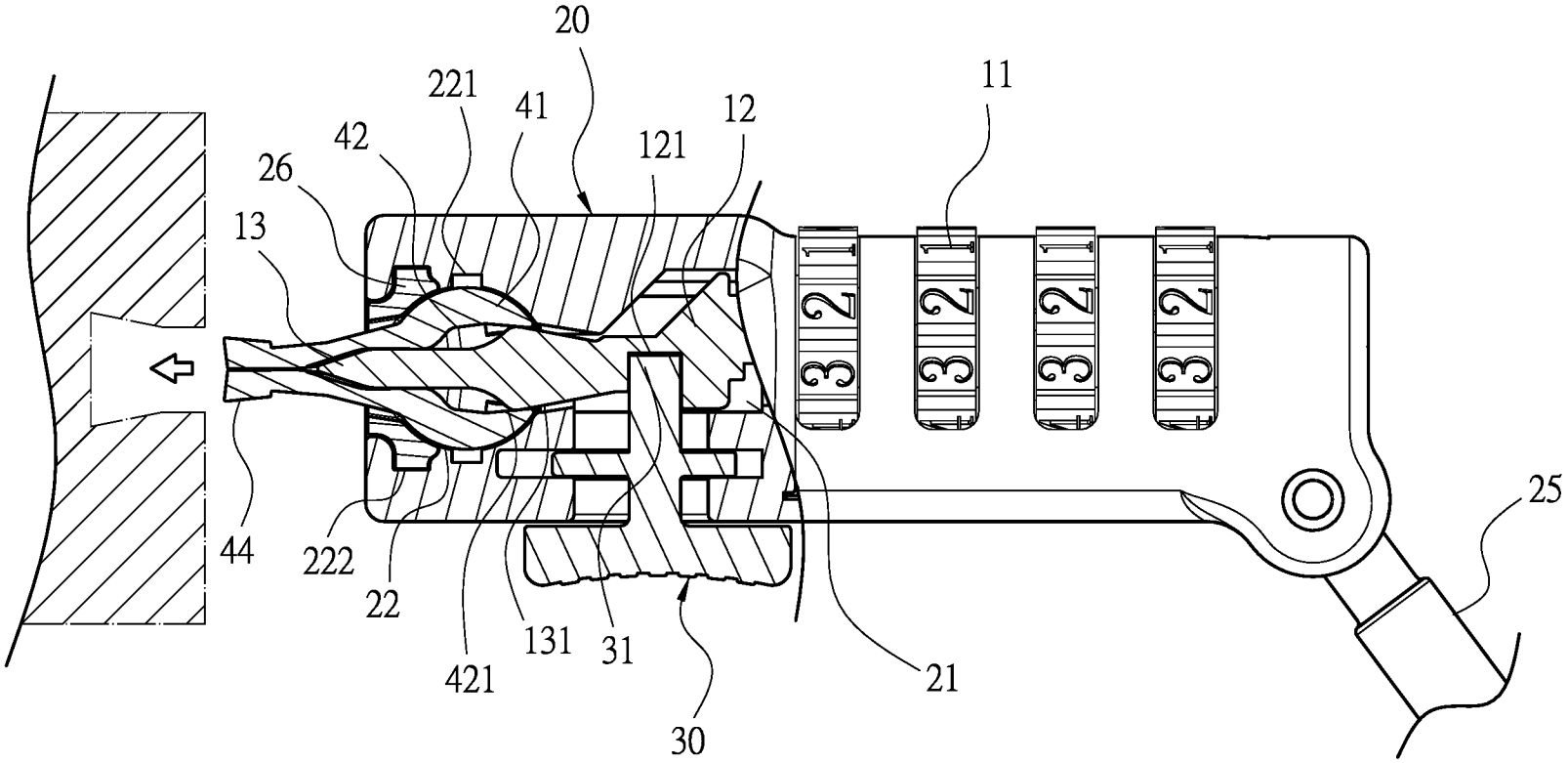
FIG. 3 is a schematic diagram of the preferred embodiment according to the preset invention.
Figure 4:
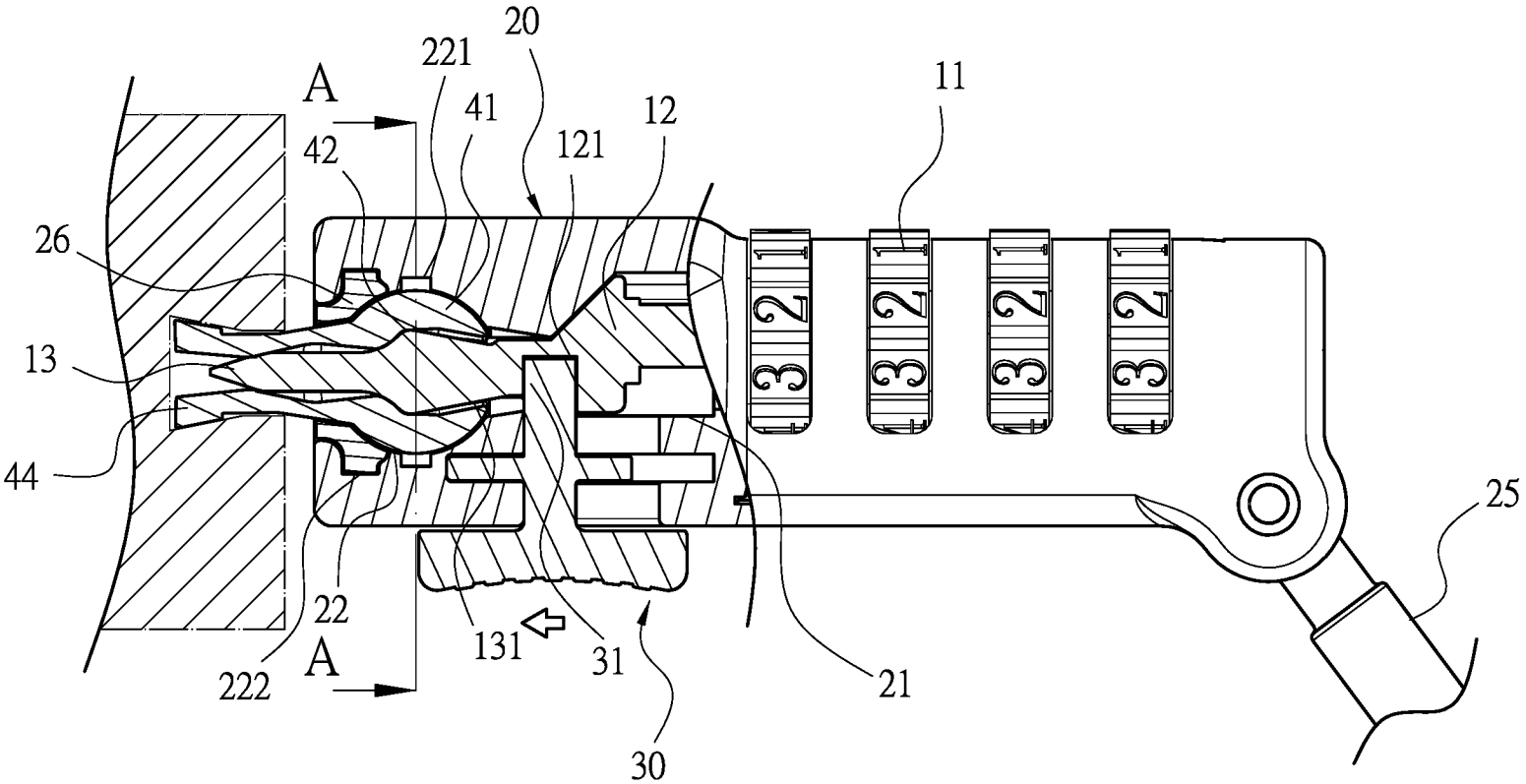
FIG. 4 is another schematic diagram of the preferred embodiment according to the preset invention.
Figure 5:
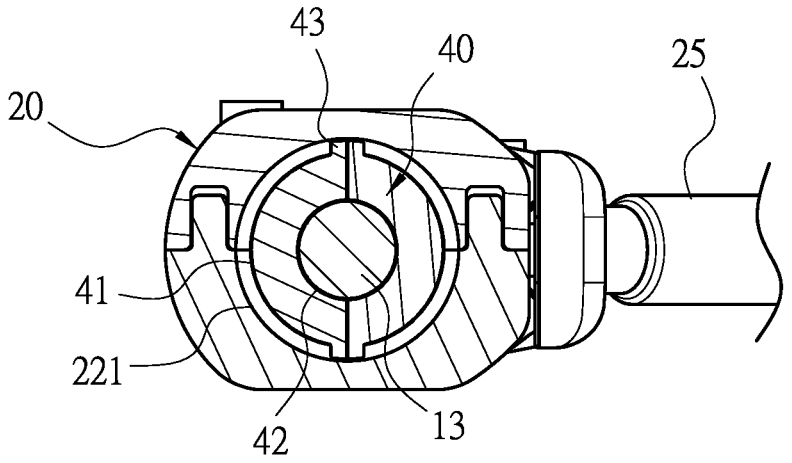
FIG. 5 is a cross-sectional view originally create along the A-A line in FIG. 4.
Figure 6:
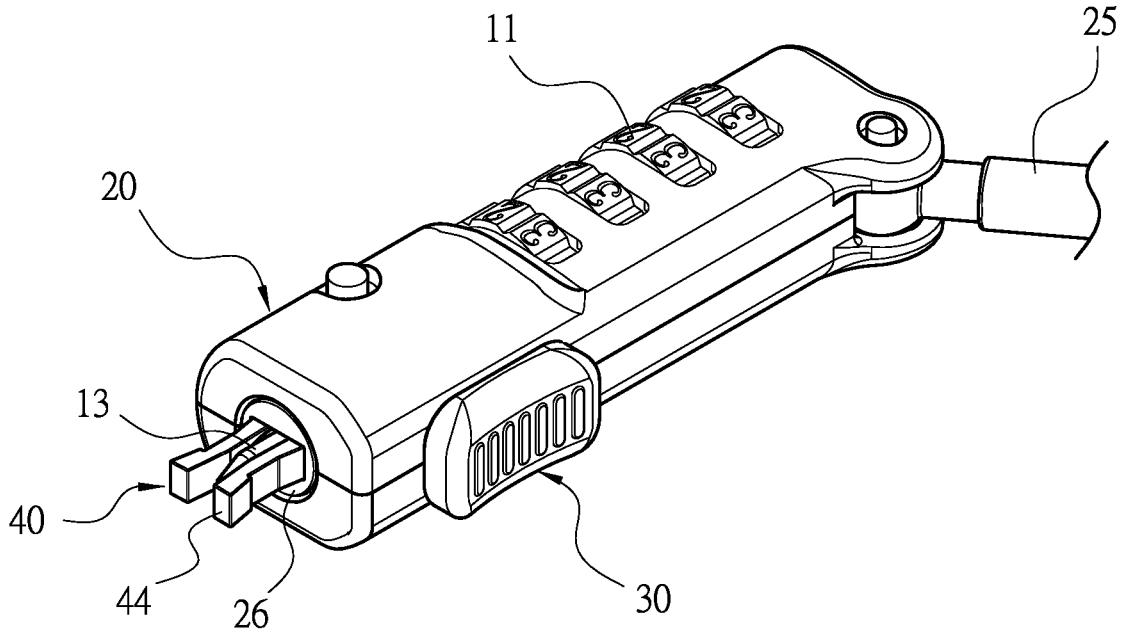
FIG. 6 is a three-dimensional schematic diagram of the rotating action of the preferred embodiment according to the preset invention.
Figure 7:
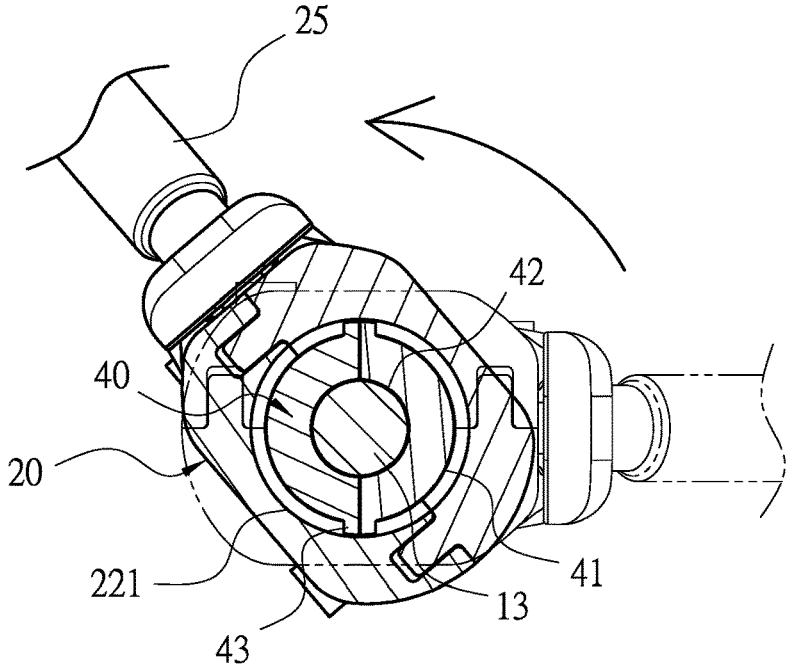
FIG. 7 is a schematic cross-sectional view of the rotating action of the preferred embodiment according to the preset invention.
Figure 8:
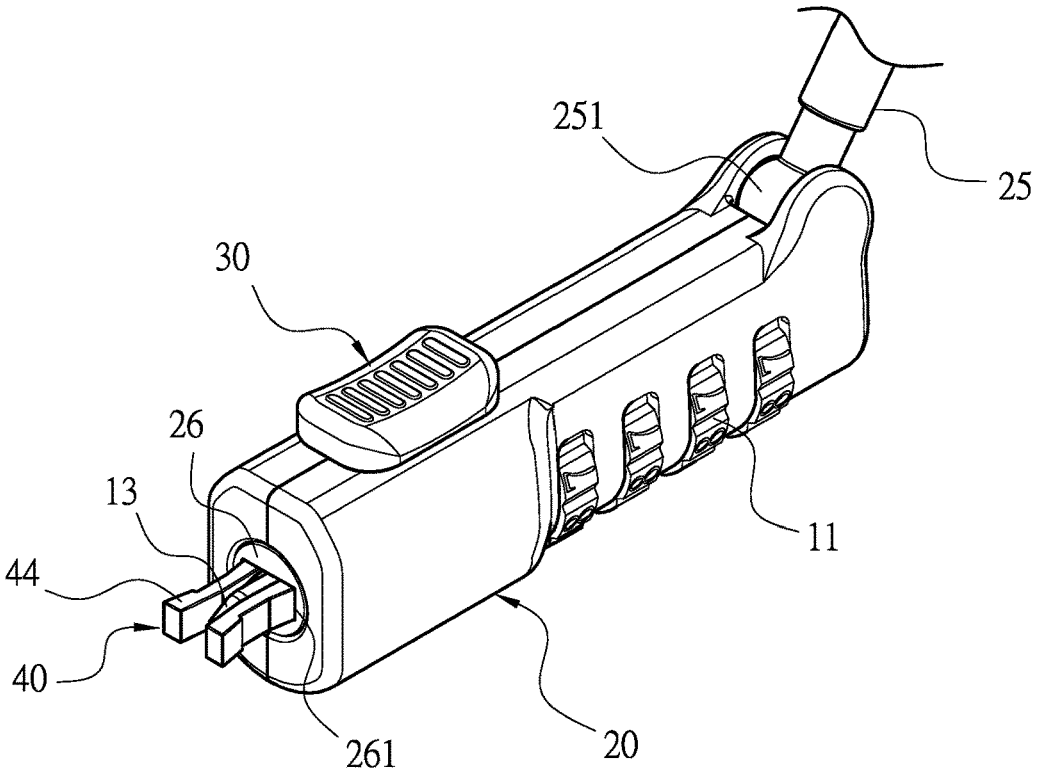
FIG. 8 is another three-dimensional schematic diagram of the rotating action of the preferred embodiment according to the preset invention.
Figure 9:
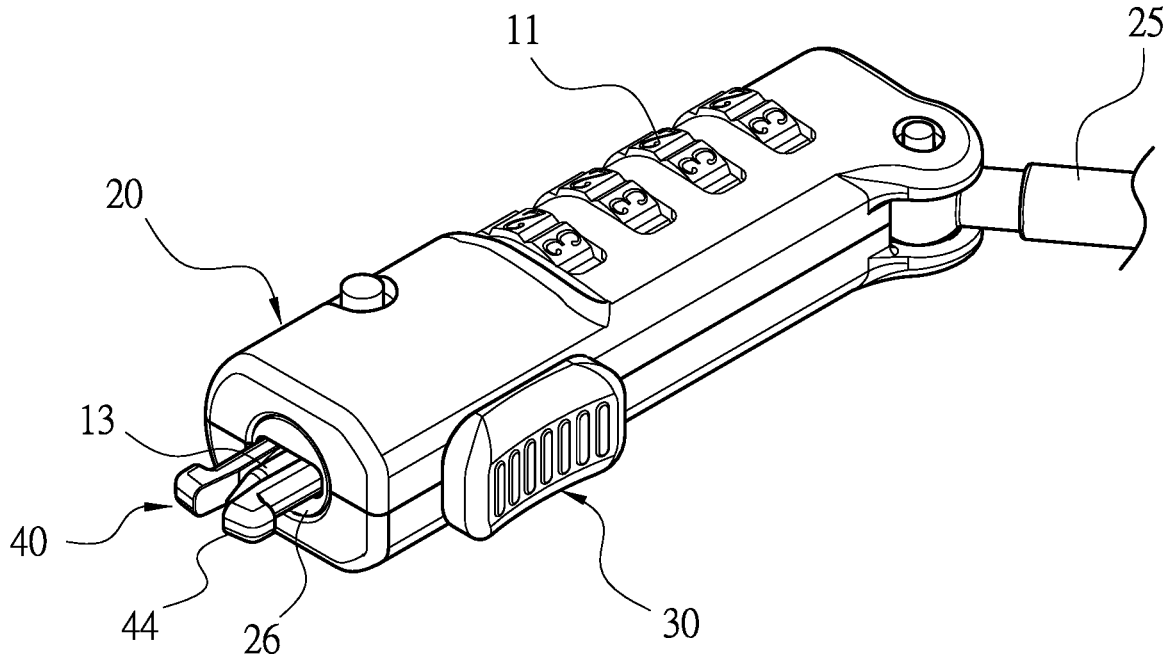
FIG. 9 is a perspective view of another embodiment according to the present invention.

First, please refer to FIGS. 1 and 2. A number lock comprises a main rod 10, a casing 20, a push knob 30 and two buckles 40. The main rod 10 is jacketed with a plurality of number rollers 11, and each number roller 11 is capable of controlling movement of the main rod 10. One end of the main rod 10 has an operating block 12 and an ejector 13. The casing 20 has two corresponding pieces enclosing the main rod 10 and exposing a portion of each number roller 11. The casing 20 further has a displacement space 21 for accepting the operating block 12 and a semispherical space 22 for accepting the ejector 13. The casing 20 has an elastic piece 23 pushing against each number roller 11 for positioning. One end of the casing 20 is provided with a round rod 24, and the round rod 24 has a ball socket 251 connected to a cable 25. The push knob 30 is partially disposed in the displacement space 21 of the casing 20 and connected to the operating block 12. The operating block 12 is provided with a through aperture 121, and the push knob 30 utilizes a cylinder 31 that is inserted in the through aperture 121 to control movement the main rod 10. The two buckles 40 respectively and symmetrically have an arced section 41 at one end disposed in the semispherical space 22 of the casing 20 and allowing the ejector 13 to pass through the arc sections 41. The ejector 13 is a round bar with a tapered head, and each buckle 40 respectively has a receiving slot 42 for accepting the ejector 13 before ejection while are closed to each other. An inner surface of the semispherical space 22 is provided with a ring slot 221, and the ring slot 221 surrounds the ejector 13 at a center position. Each buckle 40 further has at least one sliding bar 43 at the arced section 41 corresponding to the ring slot 221. Another end of each buckle 40 has an engaging arm 44 extending from the casing 20 and capable of rotation by being pushed by the ejector 13. The design of engaging arm 44 can be various, as shown in FIGS. 8 and 9. The casing 20 is provided with an outer ring slot 222 at an opening of the semispherical space 22, and the casing 20 sandwiches a round cover 26 at the outer ring slot 22. The round cover 26 further has a through opening 261 for accepting the engaging arms 44, and the casing 20 is capable of rotating around the round cover 26 along the outer ring slot 222. Furthermore, the arced section 41 is capable of sliding relatively to the semispherical space 22, such that the main rod 10, the casing 20 and the push knob 20 are capable of rotating together axially.

For actual use, please refer to FIG. 1 to FIG. 4. The main rod 10 can be unlocked by rotating the number roller 11, and the operating block 12 is pushed by the push knob 30 and moves towards the buckle 40. Since the main rod 10, the operating block 12 and the ejector 13 are integrated, the ejector 13 pushes through the receiving slot 42 of the buckle 40, so that the two engaging arms 44 are relatively opened out. A keyhole of an electronic appliance can be engaged with the expansion of the engaging arms 44, and the number rollers 11 can be arranged to achieve the purpose of anti-theft use of electronic appliances. On the other hand, in order to unlock, after the correct password is selected with the number rollers 11, the push knob 30 is pushed to pull back the ejector 13, and tapered cone-shaped surface 131 of the ejector 13 moves toward the operating block 12. Furthermore, the buckle 40 of the receiving slot 42 is provided with a stopping portion 421 inside; when the cone-shaped surface 131 of the ejector 13 is pressed against the stopping portion 421 of the buckle 40, the buckle 40 swings around the sliding bar 43 to close the two engaging arms 44, thereby achieving the anti-theft function of electronic supplies. For actual use effect, please continue refer to FIG. 5 to FIG. 8. When the ejector 13 pushes apart the two buckles 40 to make the two engaging arms 44 to engage with the electronic product, the buckles 40 and the electronic product remain still, however, the arc section 41 of the buckle 40 is capable of sliding onto the semispherical space 22 of the casing 20 because the ejector 13 is placed between the two buckles 40. Therefore, the main rod 10, the casing 20 and the push knob 30 can be simultaneously rotated along axially, which allows the number roller 11 to be adjusted to a position that is easy to view and operate in the state of being locked with electronic product.

Although the present invention has been explained in relation to its preferred embodiment, it is to be understood that many other possible modifications and variations can be made without departing from the spirit and scope of invention as hereinafter claimed.

What is claimed is:

1. A number lock comprising:

a main rod jacketed with a plurality of number rollers, each number roller capable of controlling movement of the main rod, one end of the main rod having an operating block and an ejector;

a casing having two corresponding pieces enclosing the main rod and exposing a portion of each number roller, the casing further having a displacement space for accepting the operating block and a semispherical space for accepting the ejector;

a push knob partially disposed in the displacement space of the casing and connected to the operating block; and two buckles respectively and symmetrically having an arced section at one end disposed in the semispherical space of the casing and allowing the ejector to pass through the arc section, another end of each buckle having an engaging arm extending from the casing and capable of rotating by being pushed by the ejector; each arced section capable of sliding relatively to the semispherical space, such that the main rod, the casing and the push knob are capable of rotating together axially;

wherein an inner surface of the semispherical space is provided with a ring slot, and each buckle further has at least one sliding bar at the arced section corresponding to the ring slot.

2. The number lock as claimed in claim 1, wherein the casing further has an elastic piece pushing against each number roller.

3. The number lock as claimed in claim 1, wherein the operating block is provided with a through aperture, and the push knob utilizes a cylinder that is inserted in the through aperture.

4. The number lock as claimed in claim 1, wherein one end of the casing is provided with a round rod, and the round rod has a ball socket connected to a cable.

5. The number lock as claimed in claim 1, wherein the ejector is a round bar with a tapered head, and each buckle respectively has a receiving slot for accepting the ejector.

6. The number lock as claimed in claim 1, wherein the ejector is provided with a cone-shaped surface facing the operating block, and the receiving slot of each buckle has a stopping portion; wherein when the cone-shaped surface of the ejector presses the stopping portion of each buckle, and each buckle swings around the sliding bar to close the two engaging arms.

7. The number lock as claimed in claim 1, wherein the casing is provided with an outer ring slot at an opening of the semispherical space, the casing sandwiches a round cover at the outer ring slot, and the round cover further has a through opening for accepting the engaging arms, and the casing is capable of rotating around the round cover along the outer ring slot.

* * * * *